United States Patent [19]

Seago

[11] 4,353,188

[45] Oct. 12, 1982

[54] FOOD STORAGE BUILDING

[76] Inventor: Marvin E. Seago, 1133 NW. Richmond Beach Rd., Seattle, Wash. 98177

[21] Appl. No.: 772,000

[22] Filed: Feb. 25, 1977

[51] Int. Cl.[3] ..... E04B 7/02

[52] U.S. Cl. ..... 52/93; 52/22; 52/408; 52/419; 52/520; 52/548

[58] Field of Search ..... 52/22, 404, 407, 92, 52/93, 228, 481, 479, 487, 489, 512, 520, 544, 546, 548, 408, 169.11

[56] References Cited

U.S. PATENT DOCUMENTS

| | | | |
|---|---|---|---|
| 464,961 | 12/1891 | Dickinson | 85/14 |
| 1,248,047 | 11/1917 | Woolley | 85/11 |
| 1,974,819 | 9/1934 | Koerner | 52/481 |
| 1,997,809 | 4/1935 | Cole | 52/487 |
| 2,142,060 | 12/1938 | Miner | 52/22 |
| 2,245,611 | 6/1941 | Schultz | 52/481 |
| 2,319,129 | 5/1943 | Hamilton | 52/512 |
| 2,326,717 | 8/1943 | Zeidler | 52/407 |
| 2,815,831 | 12/1957 | Hield | 52/93 |
| 3,121,649 | 2/1964 | Oliver | 52/420 |
| 3,237,360 | 3/1966 | Mills | 52/520 |
| 3,300,934 | 1/1967 | Waizenhofer | 52/489 |
| 3,385,013 | 5/1968 | Severson | 52/265 |
| 3,427,775 | 2/1969 | Bachrich | 52/481 |
| 3,474,583 | 10/1969 | Manias | 52/404 |
| 3,613,327 | 10/1971 | Hall | 52/489 |
| 3,998,016 | 12/1976 | Ting | 52/481 |

FOREIGN PATENT DOCUMENTS

| | | | |
|---|---|---|---|
| 970582 | 7/1975 | Canada | 52/169.11 |
| 2323365 | 11/1973 | Fed. Rep. of Germany | 52/479 |
| 709362 | 5/1954 | United Kingdom | 52/404 |

*Primary Examiner*—Price C. Faw, Jr.
*Assistant Examiner*—Harry E. Raduazo
*Attorney, Agent, or Firm*—T. W. Secrest

[57] ABSTRACT

This invention is directed to facilities for storing food in a controlled atmosphere wherein the temperature is regulated and the relative humidity is regulated. An important element in achieving a controlled atmosphere for the storage of food is the storage building. If the storage building is, properly, designed and constructed so as to provide a vapor barrier and also to provide thermal insulation, the storing of the food is made easier for realizing a desirable stored product. With the combination of a vapor barrier and also thermal insulation, there is less possibility of condensation of moisture in the storage building.

34 Claims, 18 Drawing Figures

FOOD STORAGE BUILDING

THE GENERAL BACKGROUND OF THE INVENTION

The storing of a perishable commodity, such as food, for a, relatively, long period of time is a difficult problem. It is necessary to provide a storage atmosphere and which atmosphere must be, carefully, maintained. For example, the storage atmosphere must be maintained within a, relatively, narrow temperature range and also must be maintained within a, relatively, narrow relative humidity range. In certain instances, extraneous gases may be introduced into the atmosphere to slow the physiological change of the food. For example, there may be introduced into the atmosphere carbon dioxide, ethyleneoxide, or other gases to slow the maturing or ripening of the food in storage.

For example, it is desirable to store potatoes for approximately twelve months. This makes it possible to process the potatoes the entire year. The investment for the processing equipment is less than if potatoes can be stored only four months and must be processed within this four-month period. If potatoes can be stored for twelve months, it makes it possible for the processor of the potatoes to have more full utilization of the processing equipment and therefore have a lower unit cost for processing equipment for unit of processed potato.

Potatoes are a staple food and have been stored in many ways. One way potatoes have been stored and are stored is in barrels. The barrels are small units. The barrels can be stored in warehouses or in ground cellars or other appropriate housings. By storing the potatoes in barrels, the spoilage and the rotting of the potatoes is localized. If rot occurs, the rot may be limited to one barrel or only a few barrels of potatoes.

Another way of storing potatoes is in burlap bags. Again, the burlap bags are small storage units. The burlap bags may be stored in a warehouse, in a ground cellar or in other suitable housings. Again, if spoilage of potatoes occurs, the spoilage may be limited to one bag of potatoes or a few bags of potatoes.

Still another way of storage of potatoes is in bins or piles. There may be a large warehouse and the potatoes may be stored in bins 6 feet, 8 feet, 10 feet, or 17 feet in height. Or, the potatoes may be stored in piles 6 feet, 8 feet, 10 feet, or 17 feet in height, for example.

Usually, for the above-described ways of storing potatoes, the potatoes in storage are subject to the outside atmosphere. The warehouse is not heated. The ground cellar or root cellar is not heated. If the outside temperature varies, the temperature in the warehouse or root cellar will vary. Generally, speaking, the potatoes are harvested in the fall at the time of harvest when the temperature may vary from approximately 50° F. to 70° F. The relative humidity may vary from approximately 20 percent relative humidity to about 90 percent relative humidity, depending upon the area of the world in which the potatoes are being harvested. In winter, the potatoes are stored in the warehouse or in the ground cellar and are subject to the outside temperatures. The outside temperatures may be relatively warm such as 30° or 40° F. Or, the outside temperatures may be relatively cold such as minus 20° F. or minus 30° F. The temperature in the warehouse or in the ground cellar will correspond closely to the outside temperature. Also, the relative humidity in the warehouse and in the ground cellar will correspond closely to the relative humidity of the outside atmosphere. Further, the relative humidity of the outside atmosphere may vary considerably. At certain times, the relative humidity may be close to 100 percent and, the relative humidity in the warehouse or the ground cellar will be similar to that. If the outside temperature suddenly falls from approximately 50° to approximately 10° F., the relative humidity at about 10° F. will be close to 100 percent but, after a few days of about 10° F., the relative humidity has decreased. Further, during the winter, when the potatoes are stored, and also into the spring, the ambient temperature of the atmosphere varies over a relatively wide temperature range, alternately heating and cooling, many times during the fall, winter and spring. Likewise, the relative humidity of the ambient atmosphere varies considerably during the fall, winter and spring. The varying temperature and the varying relative humidity of the ambient atmosphere, and also of the atmosphere in the warehouse and ground cellar, has an effect on the food in storage and on potatoes in storage.

As is well known, potato is essentially a starch with a tough skin. A critical temperature for the potato is about 45° F. If the temperature of the potato is reduced to a temperature less than approximately 45° F., possibly, less than about 43.5° F., the starch in the potato converts into a sugar. However, above about 43.5° F. or, approximately, 45° F., the starch in the potato remains a starch. If the potato is to be used to make fried potatoes, such as shoestring potatoes and potato chips, it is desirable to store the potato above about 45° F. If the potato contains sugar, the sugar in the deep far frier burns and turns brown and the potato, shoestring potato or potato chips, all have a streaked brown color which quite often is a dark brown. Therefore, it is desirable from a commercial utilization standpoint to store the potato at a temperature of about 45° F. A desirable temperature for the storing of potatoes which will be fried is a temperature in the range of about 45° to approximately 50° F. If the potatoes in storage are to be used for seed potatoes, it is desirable to have the potatoes at a temperature in the range of about 38° to about 40° F. Further, it is desirable to have the temperature of the potatoes in storage at a constant temperature and not a fluctuating temperature. If the potatoes in storage are stored at approximately 38° F., and then, suddenly, placed in an atmosphere where the temperature is much above 38° F., there is a physiological change in the potatoes and the potatoes begin to sprout.

In regard to relative humidity if the relative humidity of the atmosphere in which the potato is stored is a high humidity, there is less shrink of the potato. For example, if the atmosphere has a low relative humidity, there may be a 17 percent shrink of the potato. This means a 17 percent less potato for commercial utilization. As previously stated, the potato has a tough skin. If the relative humidity of the atmosphere in which the potato is stored is a low relative humidity, there is a quite large driving force for the transfer of moisture from inside the potato, through the tough skin and to the atmosphere. Therefore, it is desirable to have a high relative humitity for the atmosphere in which the potato is stored so as to lessen the transfer of the moisture from inside the potato and through the tough skin and into said atmosphere. In this regard, it is desirable to have the relative humidity of the atmosphere in the range of approximately 96 to 98 percent relative humidity. If the potato is bruised, there is the possibility of the potato rotting. If the relative humidity of the atmosphere in which the potato is stored is a low relative humidity, there is a greater possibility of rotting of the potato in the bruised area. Therefore, it is desirable, to lessen the possibility of rot, to have a relatively high relative humidity for the atmosphere. Further, rot in the potato spreads in storage by physical contact with water. If the potatoes are in contact with a pool of water, there is a greater possibility of the spread of rot than if the potatoes are not in contact with the pool of water. This leads to a critical situation whereby it is desirable to have a high relative humidity in the atmosphere in which the potatoes are stored but to have no pools of water in contact with the potatoes. This is possible by the careful introduction of moisture into said atmosphere. The moisture must be introduced as very fine droplets and not as large droplets. Upon being introduced as very fine droplets, the atmosphere readily absorbs the moisture.

One of the factors of assistance in controlling the temperature and the relative humidity in the storage facility is the building. There have been used many buildings and which buildings consist of a frame with an outside skin. The frame may be wood or steel and the skin may be wood or steel or aluminum. The roof of the building may be sloping or flat metal and may be of wood or sheet metal. Many times, in the past, the buildings have not had insulation and not had a moisture barrier. Another type of building can be a frame and block building wherein the frame is of steel and the block may brick, concrete block, cinder block, concrete tilt wall and the like. The roof may be flat or may be sloping and may have a protective composition cover. Again, there is, probably, no insulation and moisture barrier. In the storage facility or storage building, the humidity is above 90 percent and, preferably about 98 percent to 99 percent relative humidity. If there be no insulation and moisture barrier in the building, there is a possibility of the formation of liquid water on the floor. Assume that the temperature outside the storage building is 45° F. and the temperature inside the storage building is 45° F., the relative humidity is 98 percent. In the winter, the temperature outside the building decreases in the space of one day to 0° F. Then, with no insulation, the moisture in the atmosphere inside the building, upon contacting the roof and the walls of the building, condenses and forms into drops of water which fall onto the floor of the building. The potatoes in the building in contact with the liquid water for a period of time will spoil and rot. For example, I know of such a situation wherein the potatoes are, initially, piled in piles of about 20 feet in depth inside the building. With the sudden lowering of the outside temperature, the moisture in the building condensed and ran onto the floor of the building. The potatoes in the building started to rot and the pile of potatoes settled 4 feet so that instead of the pile being 20 feet in depth, the pile was 16 feet in depth. Naturally, the result of this type of rot is a waste of the potatoes in the storage facility.

The value of this storage facility can be readily seen when it is considered that in storage, by methods and apparatus used prior to this invention, that the rotting and the spoiling of potatoes amounted to approximately 15 percent of potatoes in storage; coupled with this spoiling of the potatoes was the shrink factor of about 17 percent. Under these conditions, there could be a loss of about 30–32 percent. And, under exceptional adverse conditions, I have seen a 100 percent loss of potatoes in storage. Prior to this invention, many farmers storing potatoes could expect a loss of about 17–20 percent of the potatoes each year. If the rotting and spoiling of potatoes can be decreased by a considerable percentage due to the teachings of this invention, it is seen that considerable food can be used for feeding people and livestock. An example of some areas of the world and the amount of acreage used for the planting of potatoes is as follows. In the United States, it is estimated that 2,000,000 acres are planted with potatoes each year. In the Union of Soviet Socialistic Republics, it is estimated that 28,000,000 acres of potatoes are planted each year. In Western Europe, it is estimated that 16,000,000 acres of potatoes are planted each year. If the spoiling and rotting of potatoes can be reduced by a relatively high percentage by better storage methods and apparatus, it is seen that many tons of potatoes are made available for feeding to human beings and to livestock.

THE GENERAL DESCRIPTION OF THE INVENTION

In this invention, there is provided a storage facility or a storage building comprising a supporting frame and an outside skin or protective skin covering the supporting frame. Also carried by the supporting frame is insulation. The insulation may serve a dual purpose as it provides insulation to the transfer of heat to and from the building and also functions as a moisture barrier. In the interior of the building, and to protect the insulation, there is an interior skin. Potatoes, when piled in high piles of 20 feet in depth, exert a considerable outward force. For example, with a wall height of 26 feet and the potatoes at a depth of 20 feet, the reaction force at the sill is approximately 1500 pounds and the reaction force at the plate is about 680 pounds. Further, the maximum bending moment is about 94,000 inch pounds. Therefore, in order to protect the insulation from damage and also to protect the outside skin from damage, there is an inside skin against which the potatoes can bear. It is to be realized that this inside skin will bend and flex, to a degree, in response to the outward force exerted by the potatoes in the pile.

An object of this invention is to have a well-insulated building and a building having a moisture barrier so as to prevent the water vapor in the building from contacting the outside skin of the building and condensing, and also a protective shield for the insulating and moisture barrier, and as a result a building which can maintain a, substantially, uniform temperature and a high relative humidity without liquid water being in the building.

THE OBJECTS AND THE ADVANTAGES

An object of this invention is to provide a low-cost storage building for food and, in particular, potatoes; a further object is to provide such a building wherein it is possible to maintain a substantially constant temperature; an important object is to provide such a building wherein it is possible to have a longer storage life for the food stored in the building, and, in particular, for potatoes stored in the building; another object is to provide such a building which can accommodate various sized loads; an important object is to provide such a building with a barrier to the flow of liquid and gas in and out of the storage building; an additional object is to provide a building with a structural frame and inside insulation whereby the structural frame can move to accommodate the load without damage to the insulation; an additional object is to provide such a building wherein the insulation is attached to the structural frame or to supports carried by the structural frame; another object is to provide such a building wherein the humidity can be controlled within a narrow relative humidity range; another object is to provide such a food storage building requiring a minimum supervision in regard to controlling the storage of the food; an additional object is to provide a building wherein the thermal insulation and also the vapor barrier are capable of moving and yet maintaining the vapor barrier; a further important object is to provide such a building so as to lessen the possibility of liquid moisture forming inside of said building; an important object of the storage facility is to provide such an open frame building for maximum storage utilization; an additional object is to provide such a building with a long expected useful life; and, a further important object is to provide such a building lending itself to minimum maintenance and also ease of maintenance.

These and other important objects and advantages of the invention will be more particularly brought forth upon reference to the detailed description of the invention, the appended claims, and the accompanying drawings.

THE DRAWINGS

Figure 3:
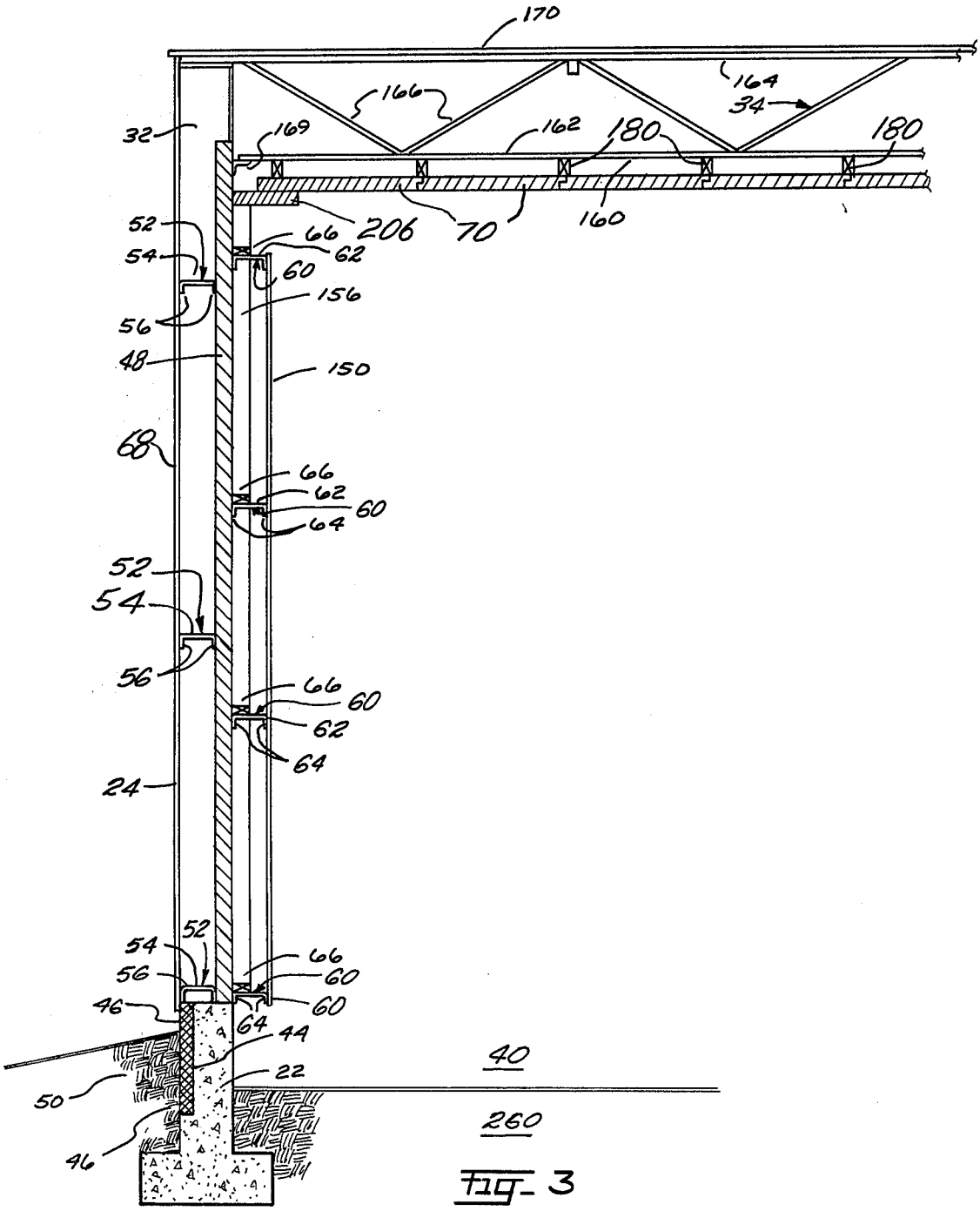
Figure 4:
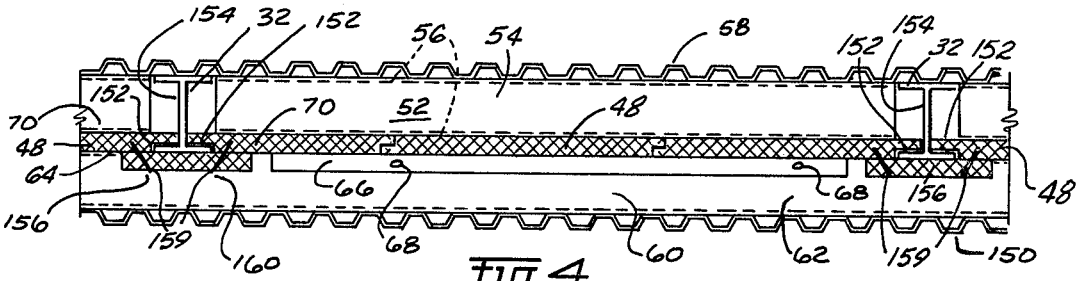
Figure 5:
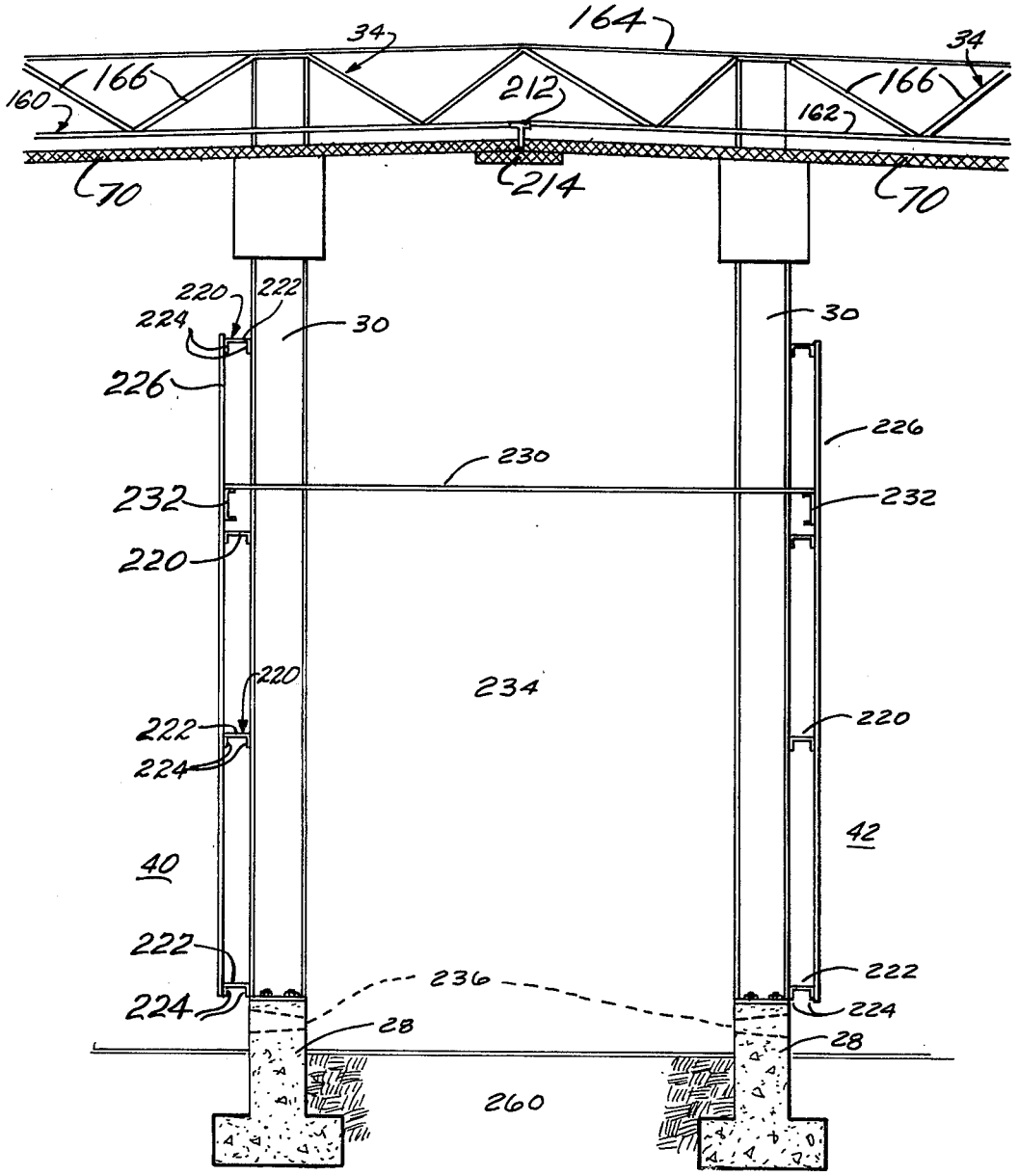
Figure 6:
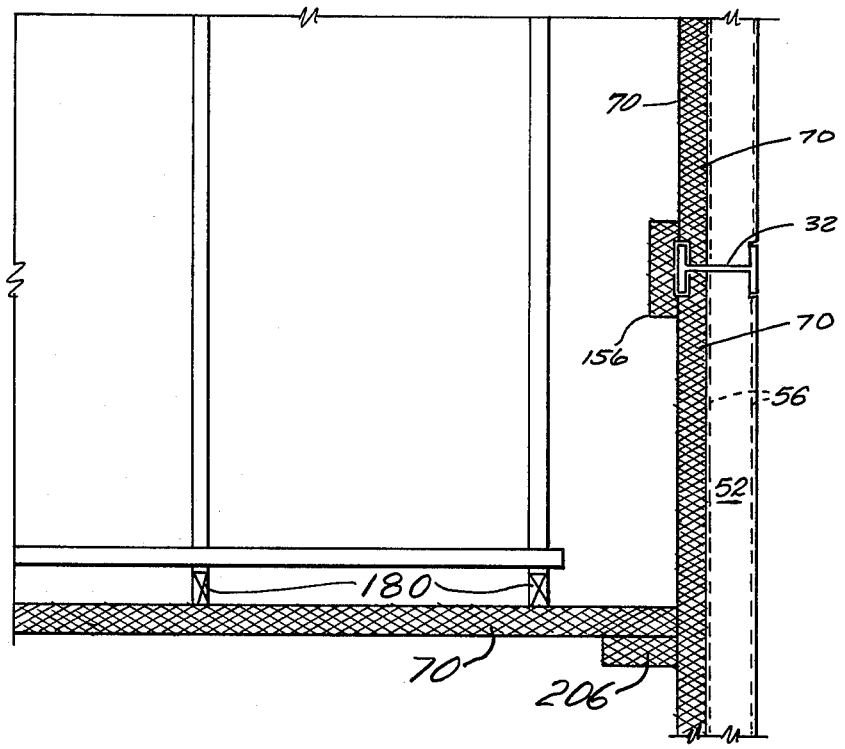
Figure 8:
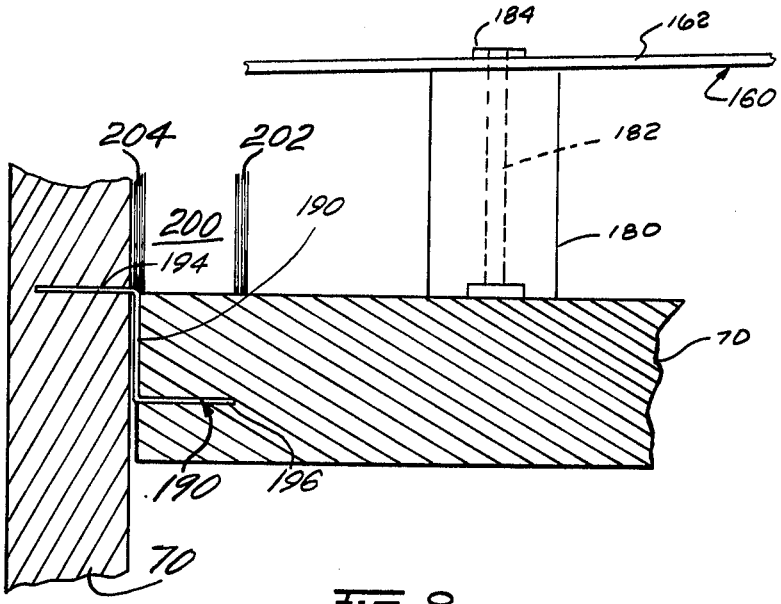
Figure 7:
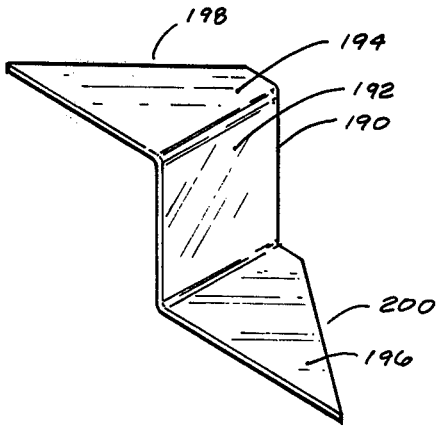
Figure 9:
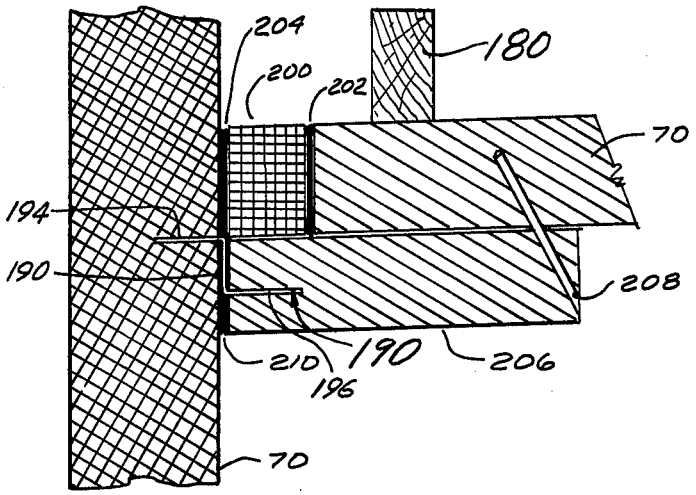
Figure 10:
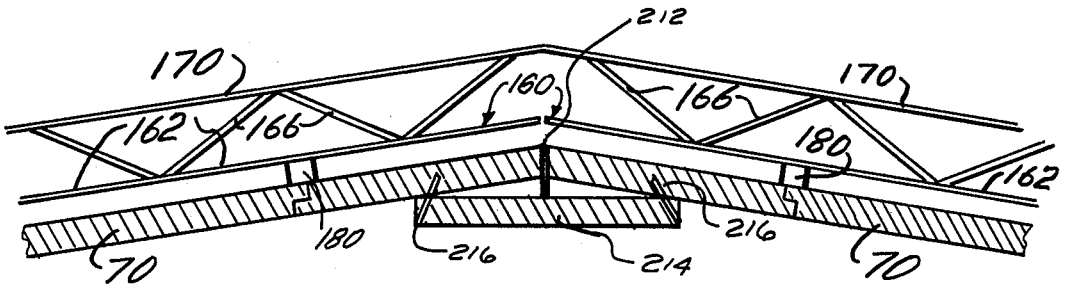
Figure 13:
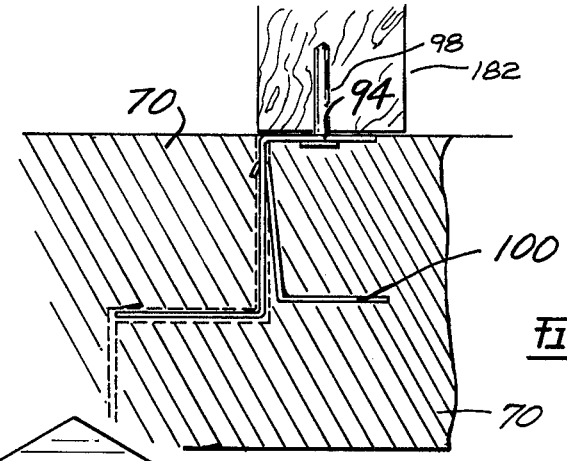
Figure 11:
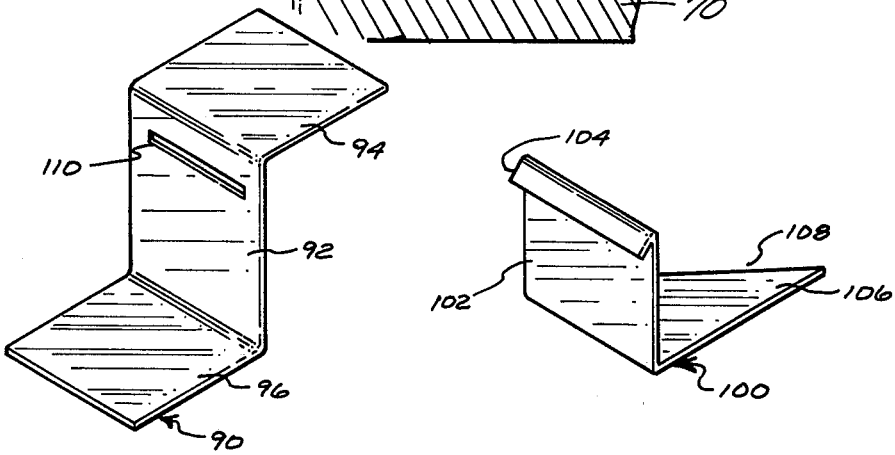
Figure 12:
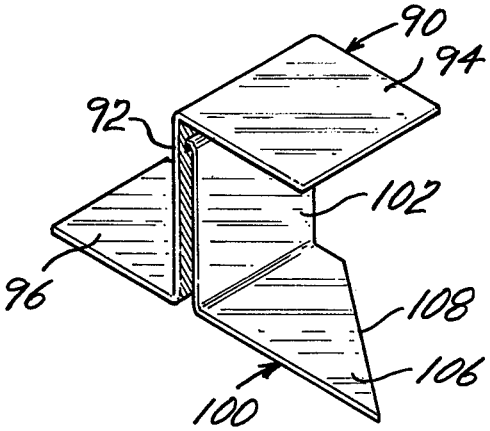
Figure 16:
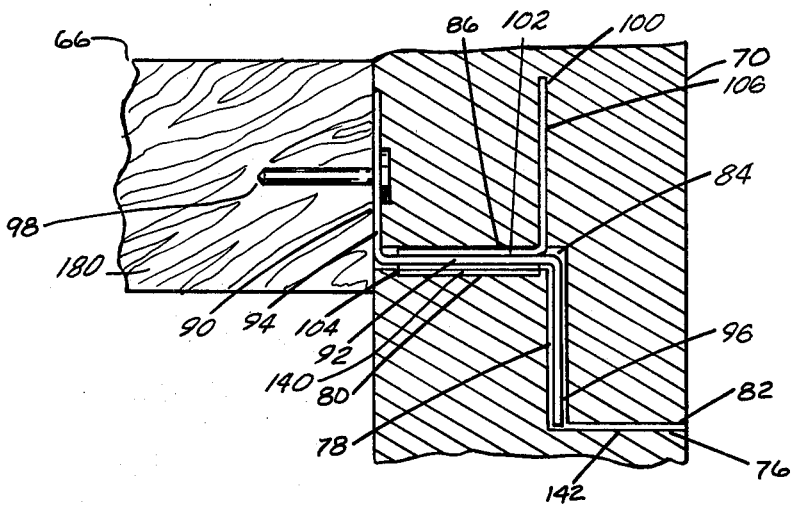
Figure 14:
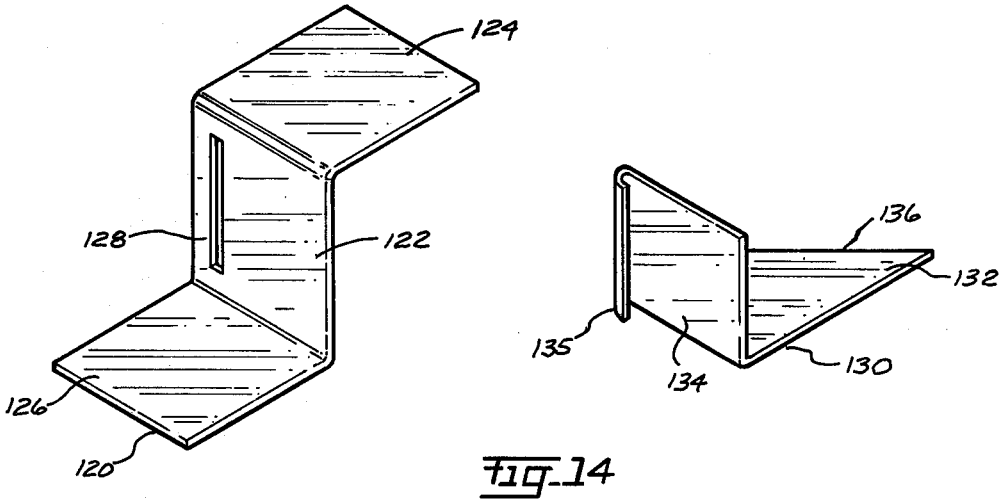
Figure 15:
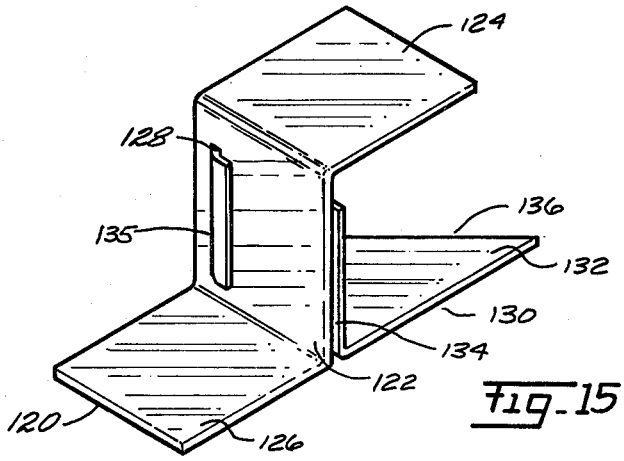
Figure 17:
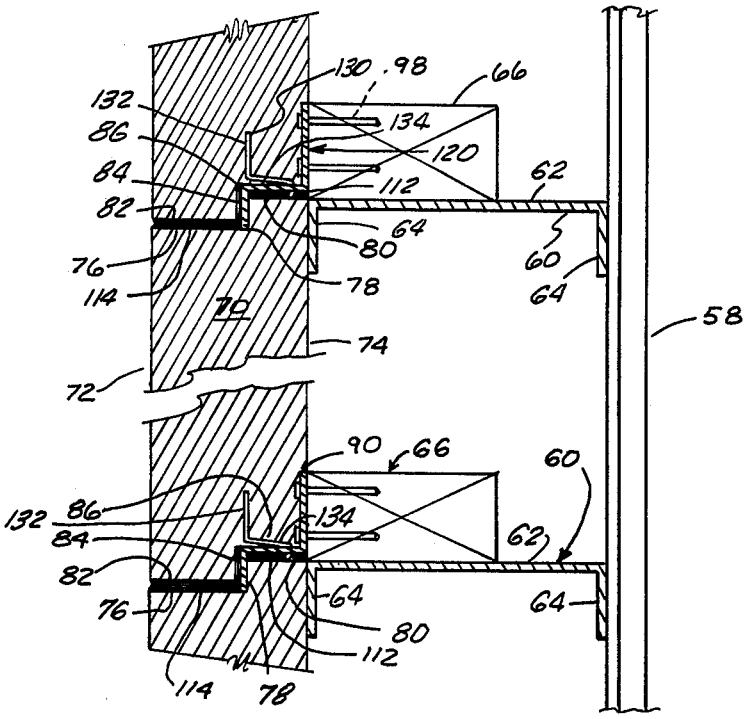
Figure 18:
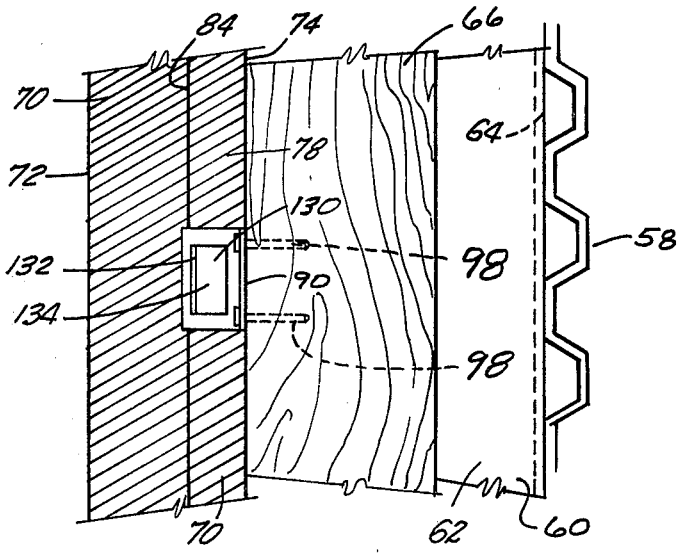

FIG. 3, on an enlarged scale, is a fragmentary vertical cross-sectional view illustrating details of construction of the outside wall, insulation and vapor barrier material, and the inside protective skin and also the roof truss, and insulation and vapor barrier skin;

FIG. 4 is a fragmentary plan view of an exterior wall and illustrates the support columns, the support member for the exterior skin, the interior insulation and vapor barrier; and the support members for the interior skin;

FIG. 5, on an enlarged scale, is a fragmentary view illustrating the support columns and the supports for the skin surrounding the plenum chamber for distributing air to the interior of the building;

FIG. 6 is a plan view, looking upward, illustrating the vertical support column, support members, insulation and vapor barrier and ceiling and roof structure;

FIG. 7 is an isometric view looking at a clip which is used for supporting insulation and vapor barrier material;

FIG. 8 is a fragmentary view illustrating roof structure, and the clip for supporting the insulation and vapor barrier material;

FIG. 9 is a fragmentary view of the junction of the exterior wall and a portion of the ceiling structure and illustrates the overlapping of the insulation and vapor barrier material so as to have a thermally insulated and moisture barrier junction;

FIG. 10 is a fragmentary vertical cross-sectional view illustrating the roof truss structure, ceiling structure and insulation and vapor barrier material at the apex of the ceiling of the building;

FIG. 11 is an exploded view illustrating the structure of a clip having a first clip and a second clip which engages with the first clip;

FIG. 12 is an isometric view looking at the first clip and second clip being joined together;

FIG. 13 is a side elevational view illustrating the first clip and the second clip in combination for use in holding insulation in position;

FIG. 14 is an exploded view illustrating another species of clips wherein there is a first clip and a second clip which can be joined together;

FIG. 15 is an isometric view looking at the first clip and the second clip when joined together;

FIG. 16 is a side elevational view illustrating the first clip and second clip joined together and for holding the insulation and vapor barrier material;

FIG. 17 is a fragmentary vertical cross sectional view illustrating the wall structure and in particular the positioning of the insulation and vapor barrier material with the aid of clips; and, FIG. 18 is a horizontal lateral cross-sectional view illustrating the wall structure and, in particular, the positioning of the insulation and vapor barrier material by means of clips.

THE DETAILED DESCRIPTION OF THE INVENTION

Figure 1:
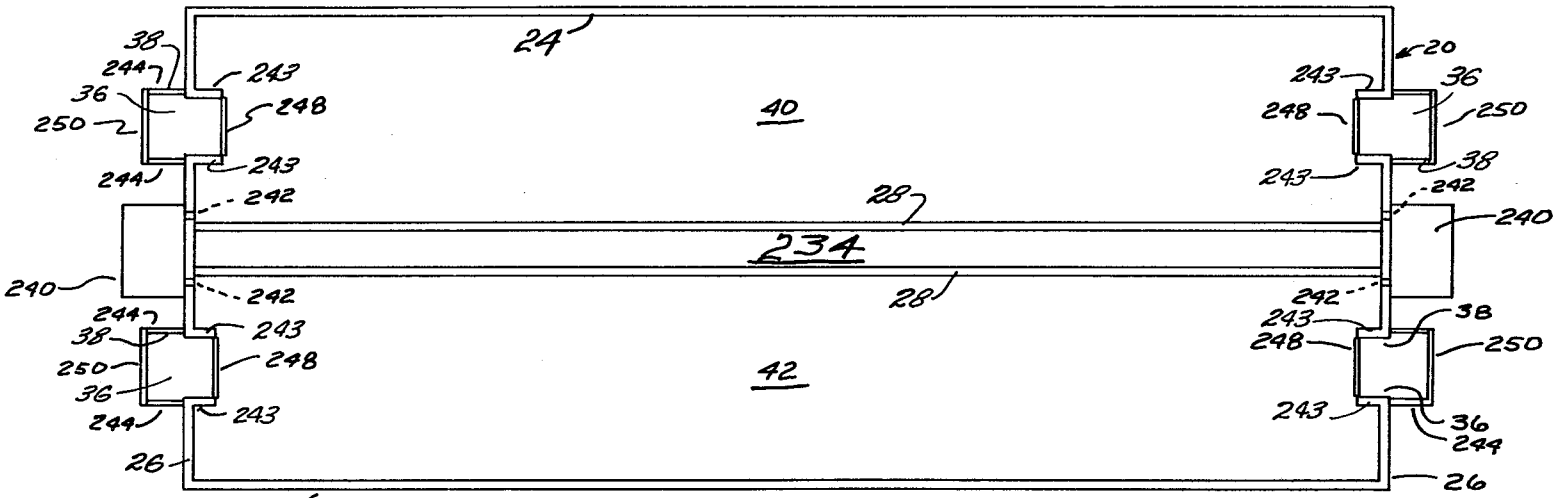
FIG. 1 is a plan view of the floor plan of a storage building constructed in accordance with the preferred teachings of this invention.
Figure 2:
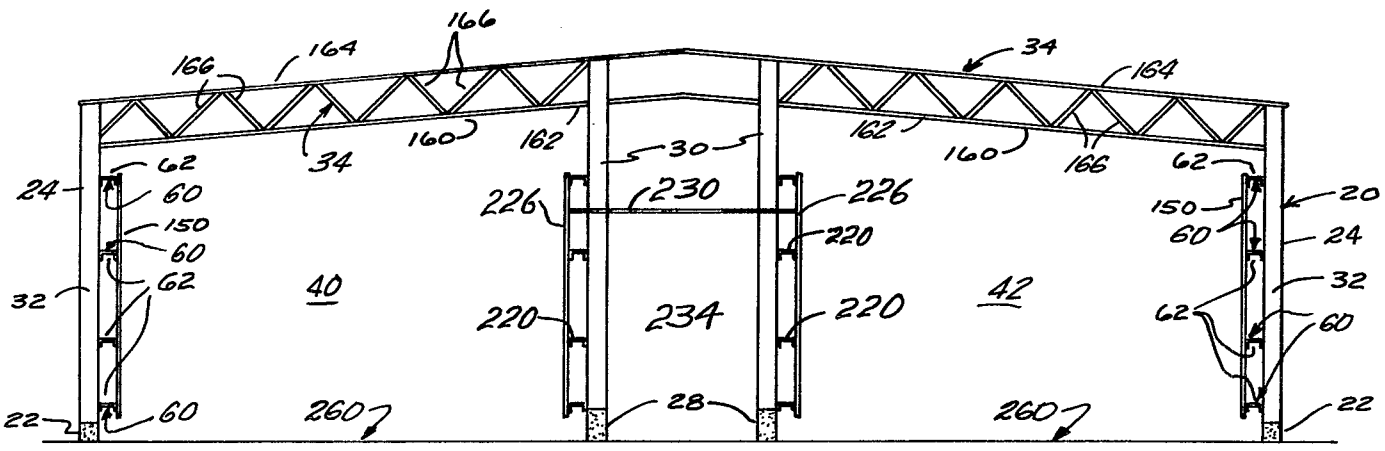
FIG. 2 is a vertical cross-sectional view of said storage building illustrating techniques of construction of the storage building.

FIG. 1 is a plan view illustrating the floor plan of the storage building 20. FIG. 2 is a vertical cross sectional view of the storage building 20.

In these drawings, it is seen that there is a perimeter footing 22. The perimeter footing 22 is of concrete or reinforced concrete. This perimeter footing is underneath the side walls 24 and the end walls 26.

There are two spaced apart central footings 28 for supporting columns 30.

On the perimeter footing 22 there are support columns 32. The support columns 30 and 32 support the two roof trusses 34.

In each of the end walls 26, there are two doorways 36. There is associated with each of the doorways 36, a housing 38 to provide thermal insulation and a vapor barrier for the building 20.

It is seen that the footings 28 and the columns 30 divide the building 20 into two long storage areas 40 and 42.

In FIG. 3, it is seen that the outside surface of the footing 22 is recessed at 44 to receive insulation 46. In FIG. 4, it is seen that there are upright columns 32 supported on the footing 22. On top of the footing 22 and between the upright columns 32, there is insulation 48. The insulation 46 insulates the upper part of the footing 22. Further, dirt or earth 50 is placed around most of the exterior of the footing 22 and also around most of the insulation 46. This dirt or earth 50 in itself functions as insulation for the footing 22. Further, the insulation 48 on top of the footing 22 and between the columns 32 lessens heat transfer from the interior of the building 20 to the atmosphere outside the building 20.

In FIGS. 3 and 4, there is illustrated a support member 52. The support member 52 has a base 54 and two downwardly directed legs 56. The support member 52 may be welded to the columns 32 or to the I-member 32. Then, there is attached to the outside leg 56 of the support member 52 an exterior skin 58. The exterior skin 58 may be corrugated galvanized steel. The exterior skin 58 is supported by the I-columns 32 and also by the support members 52.

There is positioned on the inside surface of the foot of the I-column 32, a support member 60. The support member 60 has a base 62 and two downwardly directed legs 64. The support member 60 can be welded to the inner surface of the inner foot of the column 32. Also, there is positioned on the upper surface of the base 62 of the support member 60, a 2×4 66. The wooden 2×4 66 can be bolted, as illustrated at 68, to the support member 60. The 2×4 66 functions as a fastening strip for the insulation. The insulation may be expanded polystyrene beadboard. This beadboard can be of various sizes. For example, a piece of the beadboard may be 5" in thickness and of a rectangular dimension of about 4'×12'. A 5" thick piece of beadboard has an R factor in excess of 20. Further, the beadboard is of a shiplap construction and between the joints of this beadboad there is mastic to function as a sealer. The expanded polystyrene beadboard in addition to its thermal insulation value also functions as a vapor barrier. In certain geographical areas, it is recommended that the insulation on the ceiling of the building be 5" thick and that the insulation on the walls be about 3.6" thick with an R factor of 15. The beadboard may be positioned to be vertical or horizontal.

In FIGS. 17 and 18, there is illustrated an expanded polystyrene beadboard 70. It is seen that this beadboard has an exterior surface 72, an interior surface 74, and edges. It is seen that on the upper part of the board 70 that there is a first downwardly directed edge part 78, an outwardly directed second edge 76, and an inwardly directed third edge 80. Further, on the other side of the beadboard 70, there is an inwardly directed fourth edge 82, an upwardly directed fifth edge 84, an inwardly directed edge 86. Also, it is seen that the second edge 78 and fifth edge 84 are, substantially, at right angles to the edges 76, 80, 82, and 86. In adjacent beadboard 70, the second edge 78 overlaps the fifth edge 84. Further, the first edge 76 and the fourth edge 82 are at an angle with respect to the edges 78 and 84.

To assist in holding the beadboard 70 in a vertical position, there is employed a first clip 120 having a base 122, a first leg 124, and a second leg 126. The first leg 124 is at an angle of about 90° to the base 122 and the second leg 126 is also at an angle of about 90° to the base 122. The first leg and the second leg are directed in opposed directions. In FIGS. 17 and 18, it is seen that the first leg 124 can be nailed by nails 98 or by other attaching means to the 2×4 66. The leg 124 is directed upwardly and the leg 126 is directed downwardly so as to position the second edge 78 of the beadboard 70.

To further assist in holding the beadboard 70 in place, there may be used a second clip 130 having a base 134, a fastening ledge 135 which is an extension of the base and which folds back over the base and a cutting leg 132 having a diagonal edge 136. In the first clip 120, there is a slot 128 which is, substantially, at a right angle to the junction of the base 122 and the first leg 124, or, substantially, at a right angle to the junction of the base 122, and the second leg 126. With the first clip positioned on the 2×4 66, it is possible to position the second clip 130 on the first clip 120 with the fastening ledge 135 projecting through the slot 128, see FIGS. 15 and 16. Then, in positioning the beadboard, the beadboard can be moved over the cutting leg 132 so that the diagonal edge 136 cuts into the beadboard. It is to be understood that the beadboard 70 comprises expanded polystyrene beads. The beadboard is soft and can be readily deformed or cut. Therefore, it is easy for a workman to move a piece of beadboard 70 over the cutting leg 132, to have the diagonal edge 136 cut into the beadboard. In FIG. 17, it is seen that the beadboard 70 is in a vertical position and that the cutting leg 132 of the second clip 130 positions the lower part of the beadboard and that the upper part of the beadboard is positioned by the second leg 126 of the clip 120. In this manner, the beadboard is firmly and definitely positioned onto the 2×4's 66 and between the I-columns 32.

The beadboard 70 functions as a vapor barrier and also as thermal insulation. To assist the beadboard as thermal insulation and a vapor barrier, there can be placed a mastic 112 between the third edge 80 and the sixth edge 86 of adjacent pieces of beadboard and also a mastic 114 between the first edge 76 and the fourth edge 80 and the second edge and the fifth edge 84 of adjacent pieces of beadboard. The mastic unites the adjacent pieces of beadboard 70, permitting the frame to move, separately, of the beadboard 70 without damage to the beadboard so as to maintain the insulating and vapor barrier properties of the beadboard.

In FIG. 16, there is illustrated the beadboard 70 in a substantially horizontal position. The beadboard 70 is positioned on the 2×4 180 by means of a first clip 90 having a base 92, a first leg 94 and a second leg 96. The first leg 94 is, substantially, at right angles to the base 92 and the second leg 96 is, substantially, at right angles to the base 92. The first leg 94 and the second leg 96 are directed in opposite directions. In the base 92, there is a slot 110. The slot 110 is, substantially, parallel to the junction of the base 92 and the first leg 94 and also, substantially, parallel to the junction of the base 92 and the second leg 96.

There is a second clip 100 having a base 102 and a leg 106 with a diagonal edge 108, and which diagonal edge is a cutting edge. The base 102 bends into a fastening ledge 104 which folds back on the base 102.

In FIG. 16, there is illustrated the beadboard 70 in a horizontal position. The first leg 94 is positioned on the 2×4 member 182 by means of nails 98. The base 92 is positioned between the edges 80 and 86 with the second leg 96 positioned between the edges 78 and 84. The second clip 100 is positioned in the first clip 90 with the fastening ledge 104 positioned by the slot 110 with the leg 104 in the slot 110. In FIG. 16, it is seen that the leg 106 is positioned in the beadboard 70 near the edge 86. It is to be realized that the base 92 and the leg 96 position one of the beadboards with respect to the member 180 and that the leg 106 positions the adjacent beadboard 70 with respect to the member 180. In this manner the adjacent beadboard 70 may be positioned, substantially, horizontally, with respect to the member 180.

Between the edges 80 and 86, there is mastic 140 and between the edges 76 and 82, there is mastic 142. The mastic 140 and 142 function as a moisture barrier to the passage of moisture from inside the building 20 to the exterior skin 58 and thereby preclude the condensation of the moisture on the exterior skin 58.

There is attached to the outer surface of the legs 64 of the base 62 an interior skin 150 which may be of steel plate so as to resist the outward pressure of the piles of potatoes. In FIG. 3, it is seen that the interior skin 150 can be attached to a number of the downwardly directed legs 64 of a number of bases 62. As, previously stated, the interior skin 150 protects the insulation or beadboard 70. The support member 60 may be considered to be a plurality of spaced apart spacers positioned on a first side of columns 32.

In FIG. 4, it is seen that the beadboard 70 is recessed at 152 so as to fit around the foot of the I-column 32 and also to terminate near the web 154 of the I column. The interior foot of the I-column 32 is insulated by a base of beadboard 156. The beadboard 156 is held in position on the I column and over the foot of the I column by means of light gauge wire dowels 158 which are electrically attached to the column face. The beadboard 156 is impaled on the dowels. The dowels hold the beadboard in place until the mastic has set. This type of installation is possible because the installation is made with the column in a vertical position and the insulation is installed in short pieces as established by the spacing of the support members 60 or spacer 60. Also, there may be used wooden dowels 159 for attaching the beadboard 156 to the adjacent beadboard 70. In FIG. 4, it is seen that these wooden dowels are positioned in both the beadboards 156 and 70. The insulation 156, naturally, lessens the possibility of moisture contacting the column 32 and being condensed to form liquid water in the building 20. Also, the beadboard 156 overlaps the two pieces of beadboard 70.

There are a plurality of roof trusses 160 or supporting members. The roof trusses 160 comprise a lower frame member 162, an upper frame member 164 and diagonal braces 166. The roof trusses 160 are supported on the outside I-column 32 and the inside I-columns 30. In FIG. 3, it is seen that there is an angle member 169 attached to the inside of the I column 32 and on which rests the lower frame member 162. The upper frame member 164 rests on top of the I-column 32.

In FIG. 5, it is seen that the central part of the upper frame member 164 of the roof truss 160 rests on top of the I column 30.

There is positioned on top of the upper frame member 164 of the supporting members 160 a roofing material 170. The roofing material 170 may be of galvanized sheet iron or sheet steel. The roof 170 can be attached to the trusses 160 by conventional means such as metal screws or nuts and bolts.

The building 20 has ceiling insulation for lessening the transfer of heat through the roof. The ceiling insulation may, also, be of beadboard and function as a moisture barrier. To assist the positioning of the ceiling insulation, there is attached to the lower frame member 162 of the roof truss 160, a plurality of wooden 2×4's 180 a fastening means. The 2×4's 180 may be attached to the lower frame member 162 by means of a bolt 182 and a nut 184. Th bolt 182 passes through the 2×4's 180 and also through passageway in the lower frame 162 so as to firmly attach the 2×4 182 to the roof truss 160. This is illustrated in FIG. 8.

The insulation is beadboard 70 which is attached to the member 180. The beadboard is attached by means of clips 90 and 100 to the 2×4 180 at the junction of adjacent pieces of beadboard 70. The means of attachment of the beadboard 70 to the 2×4's 180 by clips 90 and 100 has been explained with respect to positioning the beadboard 70 on the 2×4's 66, see FIGS. 17 and 18, and therefore will not be repeated. The roof truss 160 can be considered to be a supporting member for the roofing material 170 and for insulation.

In FIGS. 8 and 9, there is illustrated a clip 190 for attaching the beadboard used in the ceiling to the beadboard used in the walls. It is seen that this clip 190 has a base 192, a leg 194 with a diagonal edge 198, and a leg 196 with a diagonal edge 200. The legs 194 and 196 are, substantially, at right angles to the base 192 and are directed away from the base 192 in opposed directions. The edge of the ceiling beadboard 70 terminates near the upper part of the wall beadboard 70. In FIGS. 8 and 9, this is illustrated. A strip of beadboard 200 is positioned between the edge of the ceiling beadboard 70 and the inner surface of the wall beadboard 70. There is positioned mastic 202 between the strip 200 and the ceiling beadboard 70 and also mastic 204 between the strip 200 and the wall beadboard 70. Further, there is positioned an overlap strip of beadboard 206 underneath the ceiling beadboard 70 and adjacent to the wall beadboard 70 to assist in insulating at the junction of the ceiling and wall beadboards. This overlap strip 206 can be supported on its inner end by the clip 190. For example, the leg 194 can be inserted into the wall beadboard 70 and the leg 196 can be inserted into the edge of the overlap strip 206. The clip 190 supports and positions the edge of the overlap strip 206 near the wall beadboard 70. A wooden dowel 208 can be driven through the outer part of the overlap strip 206 and into the ceiling beadboard 70 so as to position the outer edge of the overlap strip 206. By driving the dowel 208 through the outer edge of the strip 206, the dowel also assists in supporting the strip 206. There may be mastic 210 between the edge of the strip 206 and the wall beadboard 70.

In FIG. 10, it is seen that the roof slopes to an apex and also that the ceiling beadboard 70 slopes upwardly to an apex. At the junction of the adjacent pieces of the ceiling beadboard 70, at the apex, there is a mastic 212 to seal the space between these two pieces of beadboard. Also, there can be used a capping strip 214 of beadboard. This capping strip can be relatively narrow, such as 6 inches wide or 1 foot wide and can be held in place by dowels 216. The mastic allows the adjacent pieces of beadboard to move and flex without breaking the vapor barrier or vapor seal. The thermal insulation is maintained by the beadboard, both wall beadboard and ceiling beadboard and at the junction of the wall beadboard and the ceiling beadboard, there are overlapping strips and at the apex of the ceiling beadboard, there is a capping strip. In FIGS. 3 and 9, it is seen that the wall beadboard extends up and above the ceiling beadboard.

To repeat, the thickness of beadboard can vary among the geographical areas. In certain geographical areas, a ceiling beadboard of 5" in thickness and a wall beadboard of 3.6" in thickness is satisfactory. Possibly, in an, extremely, severe climate, the ceiling beadboard may have to be thicker than 5" and the wall beadboard may have to be thicker than 3.6".

In regard to the center support, as previously stated, there are two spaced apart footings 28 and on these footings 28 are support columns 30 or I-columns 30. There is attached to the outside of the support columns 30 a plurality of channel support members 220 having a base 222 and downwardly directed legs 224. These channel support members may be welded or attached by other suitable means to the columns 30. Then, on the outside of the channel support members 220, there is attached a plenum skin 226. The plenum skin 226 may be attached by welding or other suitable connecting means. In FIG. 5, it is seen that a channel support member 220 is turned on its side and the base attached to the plenum skin 226 to function as a support for cover strip 230. The cover strip 230 can be welded or attached to the plenum skin 226 and also to that channel support member 232 which has been turned on its side. In effect, there is a plenum chamber or a closed housing 234 through which air may be moved. The air which is moved through the plenum chamber 234 may be cooling air or, if necessary, heating air and may have a high relative humidity in the range of about 98 percent to 100 percent.

In FIG. 5, it is seen that there are passageways 236 in the concrete footings leading from the plenum chamber 234 to the storage area in the building 20. It is possible to move air through the plenum chamber 234, through the passageways 236, and out into the stoage areas of the building 20.

There can be attached to the building 20 and connecting with the plenum chambers 234, control units 240. The control units 240 can contain the controls for regulating the temperature and the relative humidity of the atmosphere in the building 20. The control units can have a means for adding water vapor to the atmosphere in the building 20 and for increasing the relative humidity in the atmosphere in the building 20. Also, the control means can have a unit for the atmosphere in the building 20. In addition, the control units can have means for cooling the atmosphere in the building 20. And, the control units 240 will have means for circulating the atmosphere in the building 20 so as to have substantially constant temperature and a substantially constant relative humidity in said atmosphere. To repeat, in storage, a potato will give off heat. A pile of potatoes 20 feet high will give off considerable heat even at a temperature of about 45° F. It is necessary to circulate air through the pile of potatoes and for the air to absorb some of this heat and to remove the heat. If the atmosphere outside the building 20 is at a temperature greater than the storage temperature, then it is desirable to have a refrigeration means for lowering the temperature of the atmosphere in the building 20. If the atmosphere outside the building 20 is less than the desired storage temperature, then, an appropriate amount of the atmosphere outside the building 20 can be introduced into the building 20 to function as a cooling means for cooling the atmosphere in the building 20. There can be fans in the control units 240 for circulating the atmosphere in the building 20. For example, the atmosphere can be withdrawn from the long storage areas 40 and 42 and treated in the control units 240 and then moved through the plenum chamber 234 and reintroduced into the long storage areas. Or, the atmosphere in the long storage areas can be withdrawn through the plenum chamber 234 and reintroduced into the long storage areas. In FIG. 1, it is seen that there are passageways 242 connecting control units 240 with the long storage areas 40 and 42.

There is an opening 36. In FIG. 1, it is seen that the footing or end wall 26 turns inwardly around the opening to form an interiorly directed footing 243. Also, there is an outwardly directed footing 244. There is the housing 38 built onto the footings 244. Walls and ceiling of the housing 38 are insulated in the same manner as the walls and ceiling of the main part of the building 20. On the interior of the housing 38 or in the interior of the building 20, there is a door 248. Further, on the exterior of the housing 38, there is a door 250. The housing 38 with the doors 248 and 250 define a space where potatoes can be, temporarily stored. For example, the potatoes in the buidling 20 are stored at a temperature of about 45° F. As previously explained, if the temperature of the potatoes goes to about 43.5° F., the starch in the potato turns to sugar. If the temperature of the potato is above about 45° F., there is a problem with the sprouting of the potato. Therefore, it has been found, from experience, that a desirable temperature for storing potatoes is in the range of about 45° F. With the potatoes being stored at a temperature of about 45° F., the potatoes are crisp and can be easily damaged upon being handled. The potatoes are stored in the storage facility 20 at a temperature of about 45° F. so as to have a, readily, available potato for processing into other forms, such as shoestring potatoes, scalloped potatoes, diced potatoes, and the like. With a constant supply of potatoes, the processor of potatoes can utilize his processing equipment the entire year and have greater economic benefits from the processing equipment. In the processing of potatoes, the temperature of the potatoes should be in the range of about 55° F. to about 65° F. at a minimum so as to have a minimum of damage to the potato upon the handling of the potato. In the storage of the potato, the floor of the building 20 is a dirt floor 260. A person can drive into the building 20, scoop up the potatoes off the dirt floor with a scoop and load the potatoes into a truck or conveying vehicle. The conveying vehicle can be moved into the housing 38 and the potatoes allowed to stay in the housing 38 until the temperature of the potatoes increases from about 45° F. to about 55° F. Then, the potatoes can be moved to the processing unit for furthe handling. The housing 38, in cold weather, when the temperature outside is below about 55° F., can be heated so as to elevate the temperature of the potatoes. In warm weather, it is not necessary to heat the housing 38 and the heat from outside the building 20 can be used for heating the potatoes. From experience, it has been found that if the potatoes are in a temperature range of about 55° F. to about 65° F., they can be more readily transported from the storage building 20 to the processing building for further handling. Therefore, it is desirable to have the housing 38 with the insulated interior doors 248 and the insulated exterior doors 250. The insulation on the doors 248 and 250 can be the same as the insulation used on the walls or ceiling of the building 20.

The building is constructed so as to be able to move and flex with different loads of potatoes inside the building and also with different wind loads outside the building. The building comprises a truss system for clear spans so as to have two large storage areas 40 and 42. The inside support members attached to the column are 8" channels bolted to the inside face of the column. The bin liner or inner skin is a heavy galvanized 22 or 20 gauge sheet. The exterior skin of the building is galvanized 26 gauge sheets. The air plenum walls are the same construction as the outside walls of the building but the air plenum walls do not have insulation. The catwalk over the air plenum or plenum chamber is sealed with mastic and rubber closure so as to complete the air plenum and make it substantially airtight except for those passageways in the footing. The beadboard is of or shiplap construction and is sealed with two beads of mastic. This design provides a smooth surface without obstruction and makes it possible to trap the warmer air inside the building and below the ceiling so as to discourage condensation of the moisture in the warmer air. It is called to the reader's attention that the humidity in the building 20 is in the range of 98 to 99 percent relative humidity. The wall thickness of the building is approximately 20" wherein the column is 12" thick and the channel is 8" thick. This, in itself, provides an insulation factor, a thermal insulation factor. However, a beadboard of a thickness of 3.6" or thicker where necessary provides the main thermal insulation factor. The pressures exerted by the piles of potatoes are resisted by the interior skin and also by the interior support members or interior purlins so as to prevent damage to the insulation. An example of the storage capacity of this building is that a building about 125′ in width and about 255′ in length has a storage capacity of about 5,700 tons in each storage area or for a total storage area of about 11,400 tons of potatoes with the height of the building at the outside being approximately 27″.

In order for an invention to be patentable, it must be new, useful, and unobvious.

35 U.S.C. 101 states:

"Whoever invents or discovers any new and useful process, machine, manufacture, or composition of matter, or any new and useful improvement thereof, may obtain a patent therefor, subject to the conditions and requirements of this title."

I consider this invention to be new from the standpoint that I have provided a frame which will move and flex in response to the inside load. The frame supports an inner protective skin against which the load bears. Also, the frame supports the insulation, both the wall and ceiling insulation, so as to maintain a substantially uniform temperature inside the building. In addition, the insulation functions as a vapor barrier to preclude the air and atmosphere inside the building from contacting the exterior skin of the building and thereby precluding the moisture in the air or in the atmosphere from condensing into liquid water inside the building.

I consider that the storage building is useful as it can be used for storing food, such as potatoes, for a long period of time. It may be possible to store potatoes in this storage building for a 12-month period or for a 1-year period. One of the reasons for being able to store potatoes for this long a period of time is the building and which building can provide a uniform temperature and a uniform humidity. In addition to storing potatoes, this building can be used for storing other foods, such as apples, pears, and the like. Further, I can conceive of this storage building being used for storing articles other than food. For example, it may be desirable to store articles such as cellulose based articles or paper in this building. Another type of article which may be stored may be a mechanical article or an electrical article or a chemical article or even chemicals. It may be that this building can lend itself to the storing of chemical or mechanical or electrical apparatus because of the ability, with a minimum of cost and a minimum effort, of maintaining a uniform temperature and maintaining a uniform humidity. For the storing of items other than food, it may be desirable to have a high temperature or it may be desirable to have a low temperature and it also may be desirable to have a low humidity. Further, this building may not, necessarily, be restricted to the storing of food. It may be used for manufacturing purposes where it is desirable to have a substantially constant temperature and a substantially constant humidity. With the structure of this building and the thermal insulation and also the vapor barrier, it is possible to, easily, and readily, control the temperature and the humidity in the atmosphere inside of the building.

35 U.S.C. 103 states:

"A patent may not be obtained though the invention is not identically disclosed or described as set forth in section 102 of this title, if the differences between the subject matter sought to be patented and the prior art are such that the subject matter as a whole would have been obvious at the time the invention was made to a person having ordinary skill in the art to which said subject matter pertains. Patentability shall not be negatived by the manner in which the invention was made."

I consider this invention to be unobvious from the standpoint that I know of no other building constructed in the manner that this building is constructed. I have been in the construction industry and also associated with the construction industry for a number of years and know of no building such as this building. Further, I have seen, examined and reviewed buildings in eastern Washington which buildings are used for storing potatoes. Of all the buildings I have seen, I have not seen a structure like this structure. In the earlier part of this instrument I have mentioned buildings which have been used for storing potatoes and food. These buildings have been a wood frame and wood side buildings. These buildings are capable of shedding water but it is difficult to maintain a uniform temperature and uniform humidity inside these buildings. Another type of structure which can be used for storing potatoes and, presumably, other foods, is a pit in the earth. There is made out of the earth a pit. Then, there is provided over the pit structural support for the roof. On top of the structural support, there may be bales of straw and then over the bales of straw there can be a material for shedding water. Also, the sides of the pit can be lined with straw. The straw can be wet with water or water doused on the straw. Then, potatoes can be stored in this pit. A drawback to storing potatoes in the pit is the small volume or small weight of potatoes which can be stored in a pit. Another form of building is a steel frame building with walls of block, such as cinder block, concrete block, or a concrete tilt wall structure. This building does not have the thermal insulation value and it is difficult to maintain uniform temperature and also difficult to maintain uniform relative humidity inside the building. Another type of building is a steel frame building with an exterior steel skin and a steel roof. Again, this type of building does not have thermal insulation and it is difficult to maintain a uniform temperature inside the building and it is difficult to maintain a uniform relative humidity in the building. Further, with this type of building with a steel frame and a steel skin and a steel roof, or metal skin and metal roof with a relatively high interior temperature of 45° F. and a relative high relative humidity of about 98 percent and with a low temperature outside the building, say 0° F., the moisture inside the building condenses and forms a pool of liquid water inside the building. It is not desirable to store potatoes, and other fruit, in a building wherein there is a pool or there are pools of liquid water. Liquid water promotes the deterioration and spoilage of the food inside the building. Therefore, in view of my knowledge of buildings and the buildings that have been used for storing potatoes, I consider that this building is unobvious and satisfies 35 U.S.C. 103.

In preparing this patent application, I did not make a patent search but relied upon my knowledge of the construction of buildings for storing perishable items.

From the foregoing disclosure of my invention, what I claim is:

1. A wall for a building, said wall comprising:

a. a plurality of upright columns;

b. said columns being spaced apart;

c. a plurality of spaced apart spacers having a positioning means positioned on a first side of said columns;

d. a first wall structure positioned on said spacers;

e. insulation juxtapositioned to said columns;

f. said insulation being sheets of beadboard, a solid expanded plastic;
g. said beadboard being both thermal insulation and a barrier to the flow of moisture;
h. a mastic between adjacent pieces of beadboard to allow said adjacent pieces of beadboard to move relative to each other and to maintain a barrier to the flow of moisture;
i. a clip means connecting said insulation to said positioning means to position said insulation;
j. said first wall structure being in a shielding position to protect said insulation;
k. a second wall structure positioned on a second side of said columns; and,
l. said first wall structure and said second wall structure comprising metal.

2. A wall according to claim 1, and comprising:
a. a connecting support member between said columns; and,
b. said second wall structure positioned on said connecting support member.

3. A wall according to claim 1, and comprising:
a. a footing underneath said columns; and,
b. said insulation covering that part of the footing above ground level to function as both thermal insulation and a barrier to the flow of moisture.

4. A wall according to claim 1, and comprising:
a. said insulation being of unitary construction and free of extraneous moisture barrier material;
b. a first clip attached to said positioning means;
c. said first clip comprising a base, a first leg and a second leg;
d. said first leg being directed away from said base;
e. said second leg being directed away from said base; and,
f. said first clip positioning a first piece of said insulation with a first leg being attached to said positioning means and said second leg positioning said first piece of said insulation.

5. A wall according to claim 4, and comprising:
a. a second clip having a base, a fastening ledge at an angle to said base, and a cutting leg at an angle to said base;
b. said fastening ledge and said cutting leg being directed away from said base at opposed directions;
c. a slot in the base of said first clip;
d. said first leg projecting through said slot to position said second clip to said first clip; and,
e. said second clip positioning a second piece of said insulation and said second piece of insulation being adjacent to said first piece of insulation.

6. A wall according to claim 5, and comprising:
a. said slot being substantially parallel to the junctions of the legs and the base of the first clip.

7. A wall according to claim 5, and comprising:
a. said slot being, substantially, at right angles to the junctions of legs and the base of the first clip.

8. A wall according to claim 1, and comprising:
a. said insulation being in solid pieces and of shipla construction with overlapping edges;
b. said solid pieces of said insulation abutting each other and with the edges in an overlapping relationship; and
c. a mastic between said pieces of said insulation to function as a sealing means while allowing movement of said pieces of said insulation.

9. A building, said building comprising:
a. walls and a roof structure;
b. said walls comprising a plurality of upright columns;
c. said columns being spaced apart;
d. a plurality of spaced apart spacers having a positioning means positioned on a first side of said columns;
e. a first wall structure positioned on said spacers;
f. insulation juxtapositioned to said columns;
g. said insulation being sheets of beadboard, a solid expanded plastic;
h. said headboard being both thermal insulation and a barrier to the flow of moisture;
i. a mastic between adjacent pieces of beadboard to allow said adjacent pieces of beadboard to move relative to each other and to maintain a barrier to the flow of moisture;
j. a clip means connecting said insulation to said positioning means to position said insulation;
k. said first wall structure being in a shielding position to protect said insulation;
l. a second wall structure positioned on a second side of said columns; said roof structure comprising:
m. a supporting member having a fastening means on its lower and inner part;
n. roofing material on the upper and outer part of said supporting member;
o. insulation positioned on said supporting member;
p. said insulation being sheets of beadboard, a solid expanded plastic;
q. said beadboard being both thermal insulation and a barrier to the flow of moisture;
r. a mastic between adjacent pieces of beadboard to allow said adjacent pieces of beadboard to move relative to each other and to maintain a barrier to the flow of moisture;
s. said insulation being sheets of beadboard, a solid expanded plastic; and,
t. said first wall structure, said second wall structure and said roofing material comprise metal.

10. A building according to claim 9, and comprising:
a. a positioning means between said first wall structure and said insulation to more definitely position said insulation.

11. A building according to claim 9, and comprising:
a. a connecting support member between said columns; and,
b. said second wall structure positioned on said connecting support member.

12. A building according to claim 9, and comprising:
a. a footing underneath said columns; and,
b. said insulation covering that part of the footing above ground level to function both as thermal insulation and a barrier to the flow of moisture.

13. A building according to claim 9, and comprising:
a. said insulation being of unitary construction and free of extraneous moisture barrier material;
b. a first clip attached to said positioning means;
c. said first clip comprising a base, a first leg, and a second leg;
d. said first leg being directed away from sais base;
e. said second leg being directed away from said base; and,
f. said first clip positioning a first piece of said insulation with a first leg being attached to said positioning means and said second leg positioning said second piece of insulation.

14. A building according to claim 13, and comprising:

a. a second clip having a base, a fastening ledge at an angle to said base, and a cutting leg at an angle to said base;
b. said fastening ledge and said cutting leg being directed away from said base at opposed directions;
c. a slot in the base of said first clip;
d. said fastening ledge projecting through said slot to position said second clip to said first clip; and,
e. said second clip positioning a second piece of said insulation and said second piece of insulation being adjacent to said first piece of insulation.

15. A building according to claim 14, and comprising:
a. said slot being substantially parallel to the junctions of the legs and the base of the first clip.

16. A building according to claim 14, and comprising:
a. said slot being, substantially, at right angles to the junctions of legs and the base of the first clip.

17. A building according to claim 9, and comprising:
a. said insulation being in solid pieces and of shiplap construction with overlapping edges;
b. said solid pieces of said insulation abutting each other and with the edges in an overlapping relationship; and,
c. a mastic between said pieces of said insulation to function as a sealing means while allowing movement of said pieces of said insulation.

18. A building according to claim 9, and comprising:
a. said support member comprising a truss having an upper frame member and a lower frame member;
b. said roofing member positioned on said upper frame member; and,
c. said fastening means being positioned on said lower frame member and said insulation being positioned on said fastening means.

19. A building according to claim 18, and comprising:
a. a fastening means positioned on said lower frame member; and,
b. a clip means connecting with said fastening means and said insulation to position said insulation on said fastening means.

20. A building according to claim 13, and comprising:
a. said supporting member comprising a truss having an upper frame member and a lower frame member;
b. said roofing material positioned on said upper frame member;
c. a fastening means positioned on said lower frame member; and,
d. a clip means connecting with said fastening means and said insulation to position a first piece of said insulation on said fastening means.

21. A building according to claim 20, and comprising:
a. a second clip having a base, a fastening ledge at an angle to said base, and a cutting leg at an angle to said base;
b. said fastening ledge and said cutting leg being directed away from said base at opposed directions;
c. a slot in the base of said first clip;
d. said fastening ledge projecting through said slot to position said second clip to said first clip; and,
e. said second clip positioning a second piece of said insulation and said second piece of insulation being adjacent to said first piece of insulation.

22. A building according to claim 21 and comprising:
a. said slot being, substantially, parallel to the junctions of the legs and the base of the first clip.

23. A building according to claim 21 and comprising:
a. said slot being, substantially, at right angles to the junctions of legs and the base of the first clip.

24. A building according to claim 21, and comprising:
a. said insulation being in solid pieces and of shiplap construction with overlapping edges;
b. said solid pieces of said insulation abutting each other and with the edges in an overlapping relationship; and,
c. a mastic between said pieces of said insulation to function as a sealing means while allowing movement of said pieces of said insulation.

25. A wall for a building, said wall comprising:
a. a plurality of upright columns;
b. said columns being spaced apart;
c. a plurality of spaced apart spacers positioned on a first side of said columns;
d. a first wall structure positioned on said spacers;
e. insulation juxtapositioned to said columns;
f. said first wall structure being in a shielding position to protect said insulation;
g. a second wall structure positioned on a second side of said columns;
h. a positioning means between said first wall structure and said insulation to more definitely position said insulation;
i. said positioning means being positioned on said spaced apart spacers;
j. a first clip attached to said positioning means;
k. said first clip comprising a base, a first leg and a second;
l. said first leg being directed away from said base;
m. said second leg being directed away from said base;
n. said first clip positioning said insulation;
o. a second clip having a base, a fastening ledge at an angle to said base, and a cutting leg at an angle to said base;
p. said fastening ledge and said cutting leg being directed away from said base at opposed directions;
q. a slot in the base of said first clip;
r. said first ledge projecting through said slot to position said second clip to said first clip; and,
s. said second clip positioning said insulation.

26. A wall according to claim 25, and comprising:
a. said slot being substantially parallel to the junctions of the legs and the base of the first clip.

27. A wall according to claim 25, and comprising:
a. said slot being, substantially, at right angles to the junctions of legs and the base of the first clip.

28. A building, said building comprising:
a. walls and a roof structure;
b. said walls comprising a plurality of upright columns;
c. said columns being spaced apart;
d. a plurality of spaced apart spacers positioned on a first side of said columns;
e. a first wall structure positioned on said spacers;
f. insulation juxtapositioned to said columns;
g. said first wall structure being in a shielding position to protect said insulation;
h. a second wall structure positioned on a second side of said columns; said roof structure comprising:
i. a supporting member;
j. roofing material on said supporting member;
k. insulation positioned on said supporting member;
l. a positioning means between said first wall structure and said insulation to more definitely position said insulation;

m. said positioning means being positioned on said spaced apart spacers;
n. a first clip attached to said positioning means;
o. said first clip comprising a base, a first leg, and a second leg;
p. said first leg being directed away from said base;
q. said second leg being directed away from said base;
r. said first clip positioning said insulation;
s. a second clip having a base, a fastening ledge at an angle to said base, and a cutting leg at an angle to said base;
t. said fastening ledge and said cutting leg being directed away from said base at opposed directions;
u. a slot in the base of said first clip;
v. said fastening ledge projecting through said slot to position said second clip to said first clip; and,
w. said second clip positioning said insulation.

29. A building according to claim 28, and comprising:
a. said slot being substantially parallel to the junctions of the legs and the base of the first clip.

30. A building according to claim 28, and comprising:
a. said slot being, substantially, at right angles to the junction of legs and the base of the first clip.

31. A building, said building comprising:
a. walls and a roof structure;
b. said walls comprising a plurality of upright columns;
c. said columns being spaced apart;
d. a plurality of spaced apart spacers positioned on a first side of said columns;
e. a first wall structure positioned on said spacers;
f. insulation juxtapositioned to said columns;
g. said first wall structure being in a shielding position to protect said insulation;
h. a second wall structure positioned on a second side of said columns; said roof structure comprising:
i. a supporting member;
j. roofing material on said supporting member;
k. insulation positioned on said supporting member;
l. said supporting member comprising a truss having an upper frame member and a lower frame member;
m. said roofing member positioned on said upper frame member;
n. said insulation being positioned on said lower frame member;
o. a fastening means positioned on said lower frame member;
p. a first clip means connecting with said fastening means and said insulation to position said insulation on said fastening means;
q. a second clip having a base, a fastening ledge at an angle to said base, and a cutting leg at an angle to said base;
r. said fastening ledge and said cutting leg being directed away from said base at opposed directions;
s. a slot in the base of said first clip;
t. said fastening ledge projecting through said slot to position said second clip to said first clip; and,
u. said second clip positioning said insulation.

32. A building according to claim 31, and comprising:
a. said slot being, substantially, parallel to the junctions of the legs and the base of the first clip.

33. A building according to claim 31, and comprising:
a. said slot being, substantially, at right angles to the junctions of legs and the base of the first clip.

34. A building according to claim 31, and comprising:
a. said insulation being in solid pieces;
b. said solid pieces abutting each other; and,
c. a mastic between said pieces to function as a sealing means while allowing movement of said pieces.

* * * * *